US011167289B2

(12) United States Patent
Waters et al.

(10) Patent No.: US 11,167,289 B2
(45) Date of Patent: Nov. 9, 2021

(54) MILL LINER REMOVAL SYSTEM

(71) Applicant: Russell Mineral Equipment Pty. Ltd., Toowoomba (AU)

(72) Inventors: Steven Mark Waters, Hampton (AU); Peter John Rubie, Toowoomba (AU)

(73) Assignee: Russell Mineral Equipment Pty Ltd, Toowoomba (AU)

( * ) Notice: Subject to any disclaimer, the term of this patent is extended or adjusted under 35 U.S.C. 154(b) by 168 days.

(21) Appl. No.: 16/489,058

(22) PCT Filed: Feb. 27, 2018

(86) PCT No.: PCT/AU2018/050169

§ 371 (c)(1),
(2) Date: Aug. 27, 2019

(87) PCT Pub. No.: WO2018/157201

PCT Pub. Date: Sep. 7, 2018

(65) Prior Publication Data

US 2020/0061626 A1 Feb. 27, 2020

(30) Foreign Application Priority Data

Feb. 28, 2017 (AU) ..... 2017900684
Jun. 12, 2017 (AU) ..... 2017902225

(51) Int. Cl.
*B02C 13/282* (2006.01)

(52) U.S. Cl.
CPC .... *B02C 13/282* (2013.01); *B02C 2013/2825* (2013.01)

(58) Field of Classification Search
CPC ..... B02C 13/282; B02C 2013/2825; B02C 23/00; B02C 17/22
See application file for complete search history.

(56) References Cited

U.S. PATENT DOCUMENTS

| | | | |
|---|---|---|---|
| 3,802,150 | A | 4/1974 | Melton et al. |
| 3,804,346 | A | 4/1974 | Norman |
| 5,752,665 | A | 5/1998 | Wason |
| 6,082,646 | A | 7/2000 | Clarke et al. |
| 8,152,086 | B2 | 4/2012 | Möller et al. |

(Continued)

FOREIGN PATENT DOCUMENTS

| | | |
|---|---|---|
| CN | 204747937 U | 11/2015 |
| WO | WO 1997/026116 A1 | 7/1997 |

(Continued)

OTHER PUBLICATIONS

International Search Report dated Jul. 16, 2018 in PCT/AU2018/050169.

*Primary Examiner* — Moshe Wilensky
(74) *Attorney, Agent, or Firm* — McCarter & English, LLP

(57) ABSTRACT

The present disclosure relates to a method of removing a liner from a mill, the liner fastened to a mill shell by at least one liner bolt, the method including: (a) driving the at least one liner bolt through the mill shell until it becomes retained in the liner, whereby in a retained position, a head of the at least one liner bolt is exposed so as to project proud of the liner towards an interior of the mill; (b) engaging a tool onto the at least one liner bolt; and, (c) lifting the liner away from the mill shell using the tool to thereby enable the liner to be removed from the mill. A system for removing a liner from a mill and tool for use in removing a liner from a mill are also described.

11 Claims, 11 Drawing Sheets

(56) References Cited

U.S. PATENT DOCUMENTS

| | | | |
|---|---|---|---|
| 2012/0180364 | A1 | 7/2012 | Mepham et al. |
| 2013/0140387 | A1 | 6/2013 | Fernandez |

FOREIGN PATENT DOCUMENTS

| | | | |
|---|---|---|---|
| WO | WO 2001/028688 | A1 | 4/2001 |
| WO | WO 2012/079123 | A2 | 6/2012 |
| WO | WO 2013/090984 | A1 | 6/2013 |
| WO | WO 2016/030579 | A1 | 3/2016 |

MILL LINER REMOVAL SYSTEM

CROSS-REFERENCE TO RELATED APPLICATIONS

This application is a 35 U.S.C. § 371 National Stage filing of International Application No. PCT/AU2018/050169, filed on Feb. 27, 2018, which claims priority to Australian Patent Application 2017900684, filed on Feb. 28, 2017 and Australian Patent Application 2017902225, filed on Jun. 12, 2017.

BACKGROUND OF THE INVENTION

The present invention relates to a method and system for removing mill liners from mills, such as ore grinding mills, that have worn and need replacing.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Mill liners are sacrificial wear components used to protect the shell of a grinding mill from damage and to provide a mechanism to lift the ore charge during mill operation, for grinding the ore charge down to the required size. The mill liners need to be replaced at regular intervals, because the ore charge wears the liners down to the point where the mill shell is at risk of damage, or the grinding process efficiency has reduced significantly.

Mill liners are secured to the inside of grinding mills with fasteners. FIG. 1 shows a common fastener assembly used for securing these liners. The bolt has an oblong head that is located in an oblong cavity in the liner. The bolt is inserted into the liner and through the shell or casing of the mill by an operator on the inside of the mill. Reline personnel on the outside of the mill then install a nut and washer onto the bolt and tighten it using various torque tools.

At present, the process of removing a mill liner requires operators to be located both inside and outside of the mill. The nuts and washers are removed from the bolts on the outside of the mill using impact/rattle guns. The bolt is then pushed through the mill shell from the outside either manually by sledge hammers or by hydraulic impact hammers. Depending on many contributing factors, the liner bolts may simply slip through both the shell and the liner, and fall down onto the charge or alternatively, the oblong head of the liner bolt may remain lodged in the liner if it has peened over in which case the liner bolt and the liner fall down to the charge together. Quite often it requires some form of manual/machine assisted intervention to dislodge the liner itself from the mill shell.

Eventually the dislodged liner bolts and liners must be reclaimed from the charge level and removed from the mill as the old bolts and worn liners would damage the new liners if they were left in the mill and the mill was allowed to operate. To achieve this, bolts are typically light enough to handle manually, but the liners must be picked up by the machine being used to reline the mill referred to as a mill reline machine (MRM).

By the time a liner needs to be removed, it has worn significantly from its original shape. Typically the only original detail that remains as cast is the hole for the liner bolt and the back side of the liner facing the mill shell. The liner bolt hole in part is protected by the liner bolt. All lifting lugs and to a large extent, much of the liner profile is worn away. The worn profile of the liner is variable and unpredictable.

Slings, chains, custom lifting devices and grips are used by operators inside the mill to attach the worn liners to the MRM. The liners are then picked up and placed on a liner cart and driven out of the mill, or some other manual method is used to remove the liner bolts and mill liners from inside the mill.

It is dangerous work, operating in close proximity to the MRM in a confined space, on a wet surface that is made up of rocks and balls, in an atmosphere that is hot, humid and uncomfortable, and an environment that makes communication difficult.

It would therefore be advantageous to develop a system and method for mill liner removal that may remove the need for operators to be inside the mill in order to improve safety and mitigate the risk of potential accidents.

It is against this background, and the problems and difficulties associated therewith, that the present invention has been developed.

SUMMARY OF THE PRESENT INVENTION

In one broad form an aspect of the present invention seeks to provide a method of removing a liner from a mill, the liner fastened to a mill shell by at least one liner bolt, the method including:

a) driving the at least one liner bolt through the mill shell until it becomes retained in the liner, whereby in a retained position, a head of the at least one liner bolt is exposed so as to project proud of the liner towards an interior of the mill;

b) engaging a tool onto the at least one liner bolt; and, c) lifting the liner away from the mill shell using the tool to thereby enable the liner to be removed from the mill.

In one embodiment the tool is engaged onto at least a portion of the exposed head of the at least one liner bolt.

In one embodiment the method further includes:

a) coupling a retaining element onto the at least one liner bolt; and, b) driving the at least one liner bolt through the mill shell until the retaining element becomes jammed in a liner bolt hole of the liner to thereby retain the liner bolt in the liner.

In one embodiment the at least one liner bolt is retained proximate a rear face of the liner.

In one embodiment the retaining element is a collar that is threadedly engaged onto the at least one liner bolt.

In one embodiment the collar is tapered.

In one embodiment the collar is positioned on a shaft portion of the at least one liner bolt.

In one embodiment a diameter of the liner bolt hole in the liner is smaller than a diameter of a liner bolt hole in the mill shell.

In one embodiment during liner installation, a split reducing sleeve is inserted into the liner bolt hole of the liner proximate the rear face thereof so as to reduce the effective diameter of the liner bolt hole.

In one embodiment as the at least one liner bolt is driven through the mill shell, the collar becomes jammed in the split reducing sleeve to thereby retain the liner bolt in the liner.

In one embodiment a diameter of the liner bolt hole in the liner is substantially equal to the diameter of a liner bolt hole in the mill shell.

In one embodiment the collar is threaded onto the end of the at least one liner bolt so as to extend the effective length of the at least one liner bolt.

In one embodiment the collar is threaded onto the end of the at least one liner bolt such that an end of the at least one liner bolt bottoms out on a bottom face of a recessed portion of the collar.

In one embodiment a length of the liner bolt hole in the liner is greater than a length of the at least one liner bolt.

In one embodiment the at least one liner bolt has an extended head portion configured so as to extend the effective length of the liner bolt.

In one embodiment the extended head portion is one of:

a) attached to the head of the at least one liner bolt; and, b) integrally formed as part of the head of the at least one liner bolt.

In one embodiment the extended head portion is one of:

a) welded to the head of the at least one liner bolt; and, b) cast or forged as part of the at least one liner bolt.

In one embodiment the extended head portion provides one or more engagement portions to which the tool can be engaged to lift the liner away from the shell.

In one embodiment the engagement portions are formed by providing spaced apart recessed sections along the length of the extended head portion.

In one embodiment the liner is supported on the inside of the mill by a mill reline machine whilst the at least one liner bolt is driven through the mill shell.

In one embodiment the tool is securely attached to the mill reline machine.

In one embodiment the tool is an adaptor plate having a plurality of spaced apart teeth defining slots therebetween for receiving at least a portion of the head of the at least one liner bolt, the method further including aligning respective slots of the adaptor plate with the at least one liner bolt head and selectively gripping the at least one liner bolt by guiding the aligned slots onto the head of the at least one liner bolt.

In one embodiment adjacent teeth of the adaptor plate are profiled so as to correspond with a tapered section of the head of the at least one liner bolt.

In one embodiment the at least one liner bolt is driven through the mill shell using a hammer operated by an operator outside of the mill.

In one broad form an aspect of the present invention seeks to provide a system for removing a liner from a mill, the liner fastened to a mill shell by at least one liner bolt, the system including:

a) at least one liner bolt that is driven through the mill shell until it becomes retained in the liner, whereby in a retained position, a head of the at least one liner bolt is exposed so as to project proud of the liner towards an interior of the mill;

b) a tool configured for engagement with the at least one liner bolt; and, c) a mill reline machine securely attached to the tool and operable to lift the liner away from the mill shell after the tool has been engaged with the at least one liner bolt to thereby enable the liner to be removed from the mill.

In one embodiment the tool is engaged onto at least a portion of the exposed head of the at least one liner bolt.

In one embodiment the system further includes a retaining element that is coupled to the at least one liner bolt and wherein the at least one liner bolt is driven through the mill shell until the retaining element becomes jammed in a liner bolt hole of the liner to thereby retain the liner bolt in the liner.

In one embodiment the retaining element is a collar that is threadedly engaged onto one of:

a) a shaft portion of the at least one liner bolt; and, b) an end of the at least one liner bolt.

In one embodiment the collar is tapered.

In one embodiment the system further includes a split reducing sleeve that is inserted into the liner bolt hole of the liner proximate a rear face thereof so as to reduce the effective diameter of the liner bolt hole.

In one embodiment the at least one liner bolt has an extended head portion configured so as to extend the effective length of the liner bolt.

In one embodiment the tool is an adaptor plate having a plurality of spaced apart teeth defining slots therebetween for receiving at least a portion of the head of the at least one liner bolt.

In one embodiment adjacent teeth of the adaptor plate are profiled so as to correspond with a tapered section of the head of the at least one liner bolt.

In one broad form an aspect of the present invention seeks to provide a tool for use in removing a liner from a mill, the tool including:

a) a body adapted for attachment to a mill reline machine (MRM), the mill reline machine operable to manipulate the position of the body relative to the liner; and, b) liner bolt engagement means integral with or secured to the body that permits the tool to engage at least one liner bolt that has been driven through a shell of the mill and retained in the liner such that a head of the at least one liner bolt is exposed so as to project proud of the liner towards an interior of the mill, wherein, after the tool is engaged with the at least one liner bolt, the liner is able to be lifted away from the mill shell using the tool to thereby enable the liner to be removed from the mill.

In one embodiment the liner bolt engagement means comprise a plurality of slots formed between spaced apart teeth members for receiving at least a portion of the head of the at least one liner bolt.

In one embodiment adjacent teeth of the tool are profiled so as to correspond with a tapered section of the head of the at least one liner bolt.

It will be appreciated that the broad forms of the invention and their respective features can be used in conjunction, interchangeably and/or independently, and reference to separate broad forms is not intended to be limiting.

BRIEF DESCRIPTION OF THE DRAWINGS

Various examples and embodiments of the present invention will now be described with reference to the accompanying drawings, in which: —

DETAILED DESCRIPTION OF THE PREFERRED EMBODIMENTS

Figure 1:
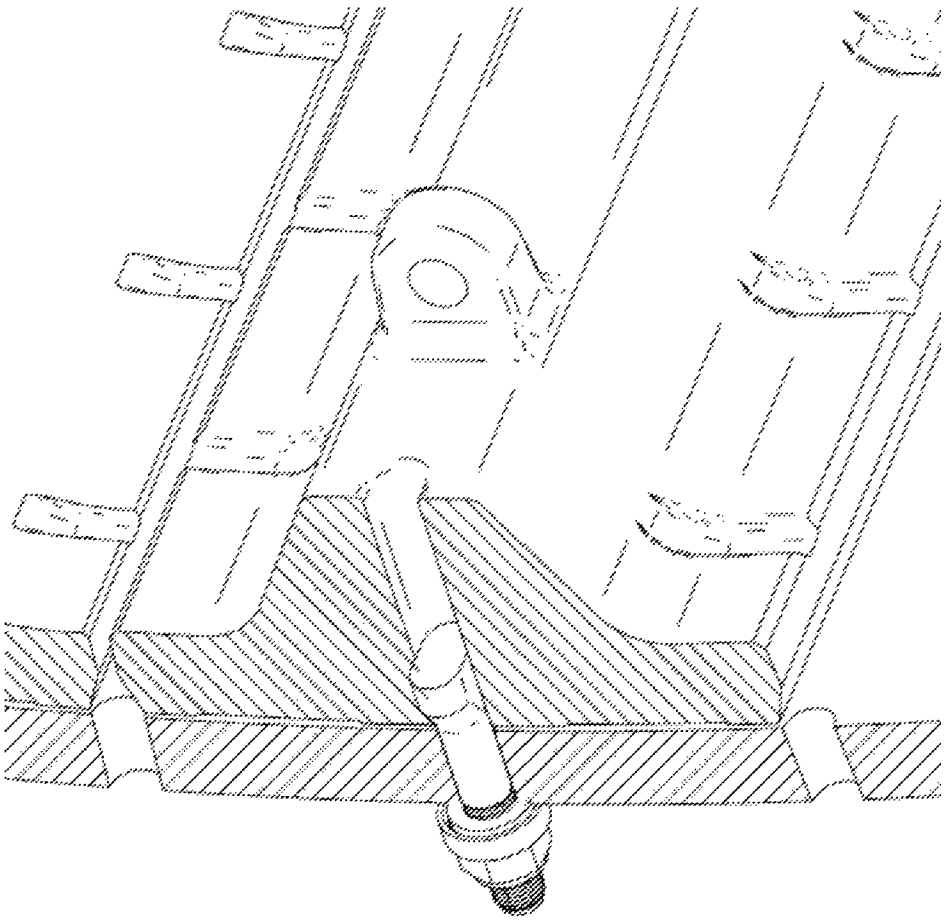
FIG. 1 is a schematic perspective cross sectional view of a traditional mill liner installation arrangement.
Figure 2:
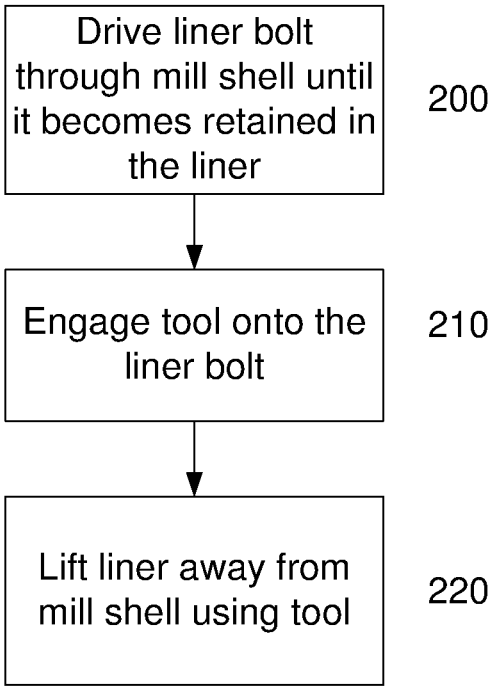
FIG. 2 is a flow chart of an example of a method of removing a liner from a mill.

An example of a method of removing a liner from a mill shall now be described with reference to FIG. 2.

It is to be appreciated that the liner is fastened to a shell or casing of the mill by at least one mounting bolt that shall hereinafter be referred to as a liner bolt.

In this example, at step 200 the method includes driving the at least one liner bolt through the mill shell until it becomes retained in the liner, whereby in a retained position, a head of the at least one liner bolt is exposed so as to project proud of the liner towards an interior of the mill. Typically, an operator outside the mill will remove the liner bolt nut and washer using impact or rattle guns. Actuation of the liner bolt occurs by pushing the bolt through the mill shell either manually using sledge hammers or by hydraulic impact hammers. As the liner bolt is pushed through the mill shell from the outside it is prevented from completely slipping through the hole in the liner so as to be retained therein as will be described in more detail below.

At step 210, the method further includes engaging a tool onto the at least one liner bolt. The tool is typically capable of gripping each liner bolt to thereby achieve an indirect connection with the liner itself via the bolts which act as anchor points. It is to be appreciated that the tool can take any suitable form that is capable of engaging with the liner bolts projecting from the liner and typically will be operable inside the mill without requiring an operator to be present inside the mill.

Finally, the method includes at step 220, lifting the liner away from the mill shell using the tool to thereby enable the liner to be removed from the mill. In this regard, the tool will typically be attached to a mill reline machine (MRM) that is operable to manipulate the position of the tool relative to the liner to thereby enable the tool to be moved into position to grip the liner bolts and then to lift the worn liner away from the mill shell.

The above described method provides a number of advantages.

Firstly, the method enables a worn liner to be safely and securely gripped whilst the liner is still in place on the shell of the mill, without the need for an operator to manually make the connection between the worn liner and mill reline machine as is current practice. The method can therefore enable a worn liner to be removed from the mill without the need for an operator to be inside the mill.

By ensuring that the head of the bolt projects sufficiently proud of the worn liner profile, the method provides the typically oblong head of the bolt as a means by which to connect the liner to the mill reline machine. During the mill grinding operation, the liner bolt is protected as the liner bolt is positioned down inside the liner bolt hole. Accordingly, the liner bolt is not typically subject to wear and the profile and cross-sectional parameters of the liner bolt therefore remain largely to manufactured specification. This enables the tool to be manufactured so that it is able to consistently interface with the exposed bolt heads without the need for an operator inside the mill to perform the connection. This is in contrast to the lifting lugs on the liner which are typically worn off and the liner itself which is typically worn to the point where its profile is variable and unpredictable.

Furthermore, the bolt provides a suitable lifting point for the liner as it is strong enough to handle many times the weight of the liner. The liner bolts also provide a mechanism that permits the liner to be gripped whilst it is still in place on the mill shell. Current worn liner lifting devices require access to the back face of the liner, whereas use of the liner bolts that have been pushed though the liner to expose the head obviates the need to access the back face of the liner.

As the liner bolts are already in place, they simply need to be driven through the liner to expose their heads to enable the tool to grip them to lift the liner. This obviates the need for any additional equipment to be manually fitted to the liner from inside the mill to enable it to be lifted.

A number of further features will now be described.

In one example, the tool is engaged onto at least a portion of the exposed head of the at least one liner bolt. Each liner bolt head typically has an oblong shape which tapers down to the shank cross section. Typically, the tool is configured to grip around the tapered section of the head, however this is not essential and in other examples the tool may simply engage a portion of the liner bolt shaft.

Typically, the method further includes coupling a retaining element onto the at least one liner bolt, and driving the at least one liner bolt through the mill shell until the retaining element becomes jammed in a liner bolt hole of the liner to thereby retain the liner bolt in the liner. The retaining element typically becomes securely wedged in the liner bolt hole of the liner by a friction or interference fit. The retaining element must accordingly be sized and/or positioned appropriately on the liner bolt to ensure that when the retaining element becomes jammed in the liner bolt hole of the liner, the head of the liner bolt projects proud of the inner face of the liner.

In one example, the at least one liner bolt is retained proximate a rear face of the liner. In other words, the retaining element typically becomes jammed in the back of the mill liner as the liner bolt is being driven through the mill shell.

In one example, the retaining element is a collar that is threadedly engaged onto the at least one liner bolt. Typically, the liner bolt is secured to the mill shell using a nut and washer. The nut and washer are first removed from outside the mill and the collar is fitted to the end of the bolt, typically along the shaft of the liner bolt. The dimensions of the liner bolt collar need to be adjusted to suit the size of the liner bolt and the diameter of the holes in the liner and mill shell.

Typically, the collar is tapered such that it will fit into the hole in the liner but jam as it is being pushed in. It is to be appreciated that the maximum diameter of the collar must be able to fit through the holes in the mill shell.

As mentioned above, the collar is typically positioned on a shaft portion of the at least one liner bolt. In this regard, the inside diameter of the collar should be threaded so as to match the thread on the shaft of the liner bolt, with a fairly loose fit so that it is easily fitted to the liner bolt, even if the liner bolt thread has been damaged slightly.

The above described arrangement is preferable for use when a diameter of the liner bolt hole in the liner is smaller than a diameter of a liner bolt hole in the mill shell. In this situation, the collar is all that is needed to retain the liner bolt in the liner.

However, this is not standard design for most grinding mills. It is in fact quite typical for a diameter of the liner bolt hole in the liner to be substantially equal to the diameter of a liner bolt hole in the mill shell. In this situation, a collar designed to avoid interference with the hole in the mill shell would also not be suitable for jamming the hole in the liner. Accordingly, the liner bolt would not be retained the liner.

To overcome this deficiency, during liner installation, a split reducing sleeve is inserted into the liner bolt hole of the liner proximate the rear face thereof so as to reduce the effective diameter of the liner bolt hole. This arrangement then ensures that as the at least one liner bolt is driven through the mill shell, the collar becomes jammed in the split reducing sleeve to thereby retain the liner bolt in the liner. The collar in this arrangement can be as previously described. The only difference is that instead of the collar jamming in the hole in the liner it will jam into the split reducing sleeve instead as the liner bolt is driven through the mill shell.

The dimensions of the split reducing sleeve are important. The sleeve should have an outside diameter slightly larger than the liner bolt hole in the liner, an inside diameter with clearance for the liner bolt to pass through it after it is pressed in and a thin flange on one end so that it seats in the back of the mill liner. The inside diameter typically tapers inward toward the internal face of the liner and the sleeve is split along its length to allow the split reducing sleeve to be easily pressed into the back of the liner by hand or with a light hammer tap on an assembly mandrel. The split reducing sleeves would be inserted into the new mill liners before they are sent into the grinding mill for placement on the mill shell.

In another example, for deep liners, a length of the liner bolt hole in the liner is greater than a length of the at least one liner bolt. When the liner bolt hole is hammered through the mill shell, it will not be long enough to enable the head of the liner bolt to project proud of the inner face of the liner so that it can be gripped by the tool.

This problem may be overcome in a number of ways. In one example, the collar is threaded onto the end of the at least one liner bolt so as to extend the effective length of the at least one liner bolt. Typically, the collar is threaded onto the end of the at least one liner bolt such that an end of the at least one liner bolt bottoms out on a bottom face of a recessed portion of the collar.

The dimensions of this extended collar need to be adjusted to suit the size of the liner bolt and the diameter of the holes in the liner and the mill shell. The outer diameter of the liner bolt extended collar should taper such that it will fit into the hole in the liner, but jam as it is being pushed in. The maximum diameter of the liner bolt extended collar must be able to fit through the holes in the mill shell however. The liner bolt extended collar should be threaded internally on one end to match the smaller tapered thread on the end of the liner bolt. The threads must be sized such that the end of the liner bolt bottoms out on the bottom face of the hole in the liner bolt extended collar. This is important as when the liner bolt is hammered out, the force of the hammer should not be transferred through the threads but through the core material of the liner bolt and the liner bolt extended collar.

It is to be appreciated that the extended collar could be used to jam into the back of a liner bolt hole in the liner either directly or via a split reducing sleeve as previously described if the diameter of the liner bolt hole in the liner is nominally the same as the diameter of a liner bolt hole in the mill shell.

In another example, the at least one liner bolt has an extended head portion configured so as to extend the effective length of the liner bolt. The additional length provided by the extended head portion ensures that as the bolt is driven through the mill shell until it becomes retained in the liner, at least part of the extended head portion of the liner bolt will be exposed so as to project proud of the liner towards an interior of the mill. In this way, even with deep liners, a tool will always be able to grip the head (or extended head) of the liner bolt when it is driven through the shell from the outside to thereby enable mill liners to be efficiently removed without requiring an operator inside the mill.

It will be appreciated that the extended head portion may be either attached to the head of the at least one liner bolt or integrally formed as part of the head of the at least one liner bolt. Accordingly, in one example the extended head portion is welded to the head of a standard liner bolt so as to extend its effective length. Alternatively, the extended head portion may be cast or forged as part of the at least one liner bolt such that the extended head and liner bolt are a single homogenous part.

Typically, the extended head portion provides one or more engagement portions to which the tool can be engaged to lift the liner away from the shell. The engagement portions may be formed by providing spaced apart recessed sections along the length of the extended head portion. The formation of these recessed, notched or flat sections along the length of the extended head portion creates flanges or lips that can be used to engage with the tool. In one example, the extended head portion is configured so that the tool can engage around flanged sections (that may be tapered) disposed at intermediate and end portions of the extended head portion. Providing multiple locations for gripping is advantageous as it is unknown how much wear the liner will be subject to, and regardless of how much wear there is on both the liner and the liner bolt, once the liner bolt collar is seated in the back of the liner, there will always be a location extended head portion of the liner bolt which can be gripped using the tool.

Typically, the liner is supported on the inside of the mill by a mill reline machine whilst the at least one liner bolt is driven through the mill shell. This support is necessary as once the nut on the outside of the mill shell is removed and the liner bolts driven through the mill shell there is nothing holding the liner to the shell anymore. Therefore, in order to prevent the liner falling from the shell onto the charge beneath it is desirable for the mill reline machine to hold the liner in place as the liner bolts are being pushed through.

In addition to providing support to the liner to prevent it falling away from the shell as the liner bolts are being hammered through, the mill reline machine is also used to manipulate the position of the tool relative to the liner. In this regard, the tool is securely attached to the mill reline machine, for example to an arm, boom or the like that is able to be controlled to thereby move the tool as required.

In one example, the tool is an adaptor plate having a plurality of spaced apart teeth defining slots therebetween for receiving at least a portion of the head of the at least one liner bolt. The method may therefore further include aligning respective slots of the adaptor plate with the at least one liner bolt head and selectively gripping the at least one liner bolt by guiding the aligned slots onto the head of the at least one liner bolt.

In order to achieve a strong grip between the adaptor plate and liner bolts, adjacent teeth of the adaptor plate are profiled so as to correspond with a tapered section of the head of the at least one liner bolt.

The above described method for removing a worn liner from a mill can be achieved without an operator being required inside the mill. In this method, the operator is typically located outside the mill for example to facilitate driving the at least one liner bolt though the mill shell using a hammer or the like.

In another broad form, the invention provides a system for removing a liner from a mill, the liner fastened to a mill shell by at least one liner bolt, the system including at least one liner bolt that is driven through the mill shell until it becomes retained in the liner, whereby in a retained position, a head of the at least one liner bolt is exposed so as to project proud of the liner towards an interior of the mill. The system further includes a tool configured for engagement with the at least one liner bolt, and a mill reline machine securely attached to the tool and operable to lift the liner away from the mill shell after the tool has been engaged with the at least one liner bolt to thereby enable the liner to be removed from the mill.

In yet a further broad form, the present invention provides a tool for use in removing a liner from a mill, the tool including a body adapted for attachment to a mill reline machine (MRM), the mill reline machine operable to manipulate the position of the body relative to the liner. The tool further includes liner bolt engagement means integral with or secured to the body that permits the tool to engage at least one liner bolt that has been driven through a shell of the mill and retained in the liner such that a head of the at least one liner bolt is exposed so as to project proud of the liner towards an interior of the mill, wherein, after the tool is engaged with the at least one liner bolt, the liner is able to be lifted away from the mill shell using the tool to thereby enable the liner to be removed from the mill.

In one example, the liner bolt engagement means comprise a plurality of slots formed between spaced apart teeth members for receiving at least a portion of the head of the at least one liner bolt. Typically, the teeth are integral with the body which may be a plate like structure. As previously described, adjacent teeth of the tool are typically profiled so as to correspond with a tapered section of the head of the at least one liner bolt to facilitate a strong connection therewith.

Figure 3A:
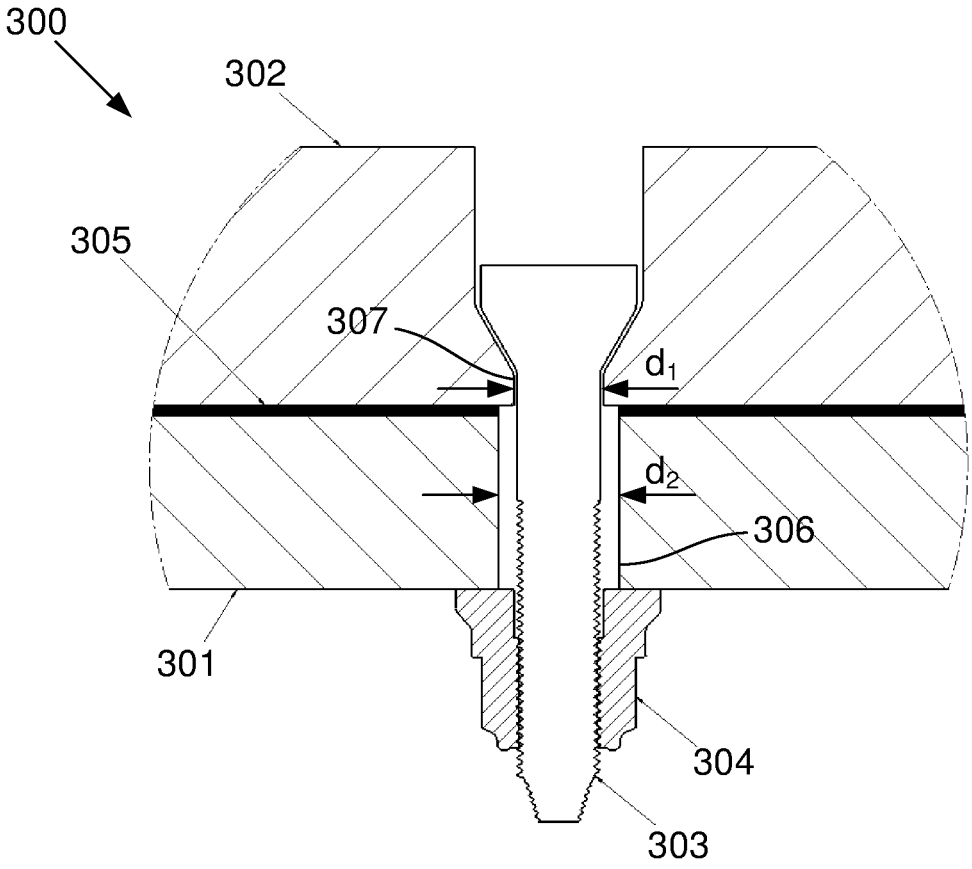
FIG. 3A is a schematic cross sectional view of an example of a mill liner installation arrangement in which the diameter of the bolt hole in the liner is smaller than the diameter of the bolt hole in the mill shell.

Referring now to FIG. 3A, an example of a mill liner installation arrangement 300 in which the diameter of the bolt hole in the liner is smaller than the diameter of the bolt hole in the mill shell is shown.

In this example, a liner 302 is fixed to a mill shell 301 via at least one liner bolt 303. The liner bolt 303 extends through a hole 307 in the liner 302 and a hole 306 in the shell 301 so that an end of the liner bolt protrudes outside the shell 301. The liner bolt 303 is fastened to the shell 301 by a nut (and captured washer) 304. A rubber lining 305 is used to line the inside diameter of the mill shell 301 and sits between the mill liner 302 and shell 301. It will be appreciated that the mill liner 302 is fitted into the mill, preferably using advanced mill relining techniques that do not require an operator to be present inside the mill, but that standard relining techniques where operators are present inside the mill could also be used.

The setup shown in FIG. 3A represents a setup used in an operating grinding mill, prior to a mill reline commencing. In this example, the diameter d1 of the bolt hole in the liner 302 is smaller than the diameter d2 of the bolt hole in the mill shell 301.

When a mill reline is commenced, the liner bolt nut 304 is firstly removed from the liner bolt 303 by an operator outside of the mill. A liner bolt collar 310, for example as shown in FIG. 3C, is then threaded onto the shaft of the liner bolt 303. The collar 310 has a frusto-conical body that tapers from a first end 311 to a second end 312 and is internally threaded.

The liner 302 is then typically supported on the inside of the mill by the mill relining machine. This prevents the liner 302 from coming away from the shell 301 and falling down to the charge whilst the liner bolts 303 are being hammered through the shell 301. With the liner 302 supported, an operator hammers the end of the liner bolt 303 from outside the shell 301 to thereby drive the liner bolt 303 through the shell 301. The liner bolt 303 is driven until the collar 310 jams into the back of the mill liner 302 proximate a rear face 302B thereof. As the collar 310 is tapered, it will become progressively more jammed in the bolt hole of the liner 302 the more it is driven through the shell 301. Eventually, the collar 310 will prevent further movement of the liner bolt 303 and it will become retained or captured in the liner 302.

Figure 3B:
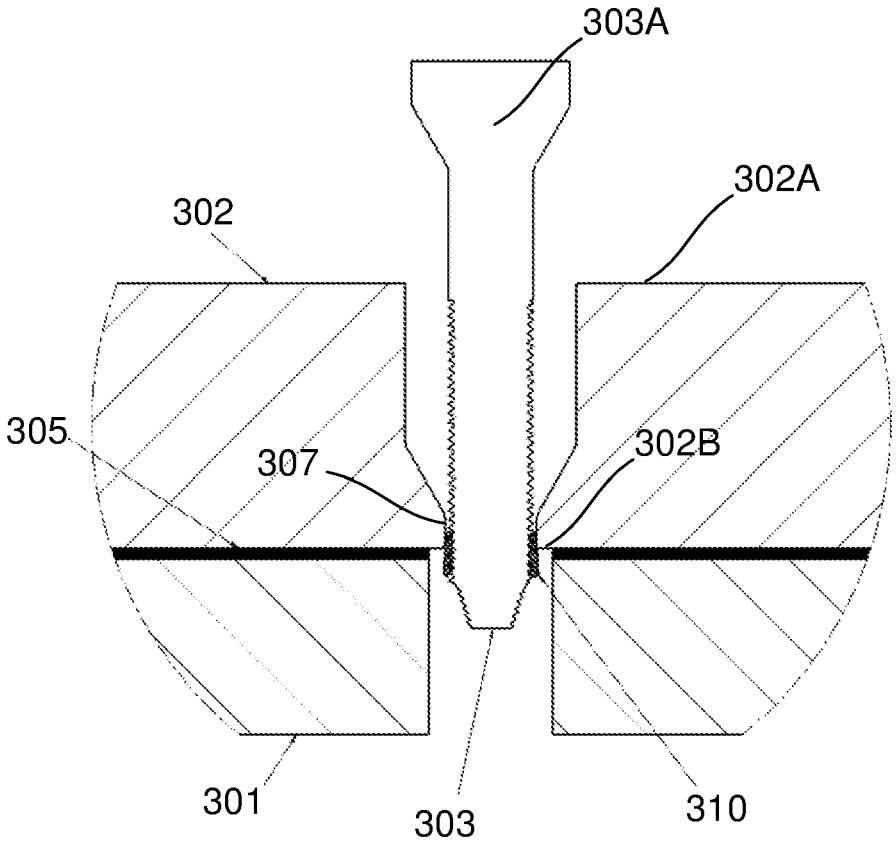
FIG. 3B is a schematic cross sectional view of the installation of FIG. 3A during liner removal.
Figure 3C:
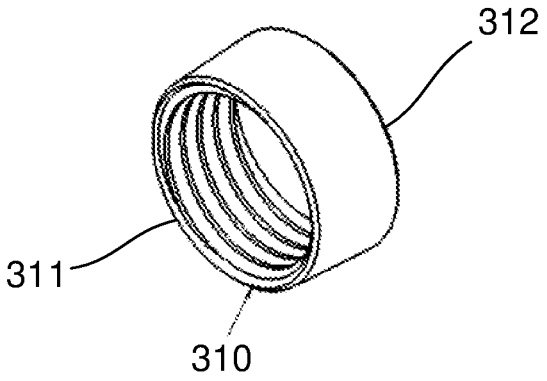
FIG. 3C is a schematic perspective view of a liner bolt collar that is fitted onto the liner bolt during liner removal.

In a retained position as shown in FIG. 3B, a head 303A of the liner bolt 303 is exposed so as to project proud of the liner 302 towards an interior of the mill. The head 303A must project sufficiently proud of the worn liner profile to enable a tool to grip the exposed head as will be described in further detail below.

Figure 4A:
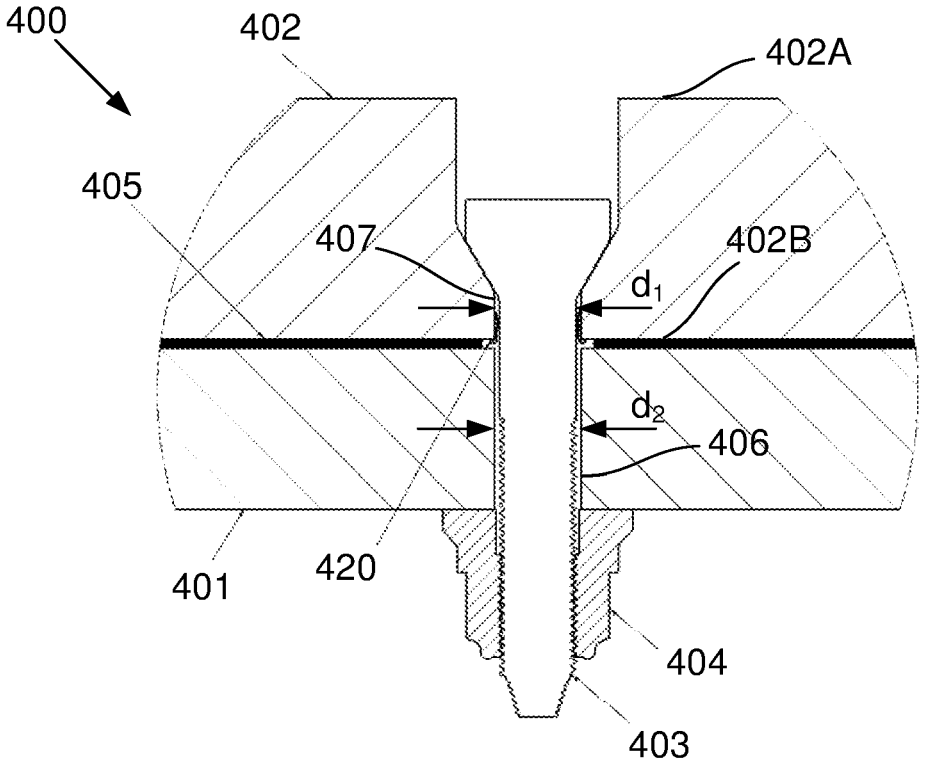
FIG. 4A is a schematic cross sectional view of an example of a mill liner installation arrangement in which the diameter of the bolt hole in the liner is nominally equal to the diameter of the bolt hole in the mill shell.

Referring now to FIG. 4A, an example of a mill liner installation arrangement 400 in which the diameter of the bolt hole in the liner is nominally the same as the diameter of the bolt hole in the mill shell is shown.

In this example, a liner 402 is fixed to a mill shell 401 via at least one liner bolt 403. The liner bolt 403 extends through a hole 407 in the liner 402 and a hole 406 in the shell 401 so that an end of the liner bolt protrudes outside the shell 401. The liner bolt 403 is fastened to the shell 401 by a nut (and captured washer) 404. A rubber lining 405 is used to line the inside diameter of the mill shell 401 and sits between the mill liner 402 and shell 401. It will be appreciated that the mill liner 402 is fitted into the mill, preferably using advanced mill relining techniques that do not require an operator to be present inside the mill, but that standard relining techniques where operators are present inside the mill could also be used.

The setup shown in FIG. 4A represents a setup used in an operating grinding mill, prior to a mill reline commencing. In this example, the diameter d1 of the bolt hole in the liner 402 is nominally the same as the diameter d2 of the bolt hole in the mill shell 401. In this example, in order to retain the liner bolt 403 in the liner 402, a split reducing sleeve 420 is inserted into the bolt hole 407 in the liner proximate a rear face 402B thereof. The split reducing sleeve 420 acts to reduce the effective diameter of the bolt hole in the liner 402. The split reducing sleeve 420 is installed into the back of the mill liner before it is placed into the mill (that is during the initial lining operation, when the mill liner is new and before it becomes a worn liner).

Figure 4B:
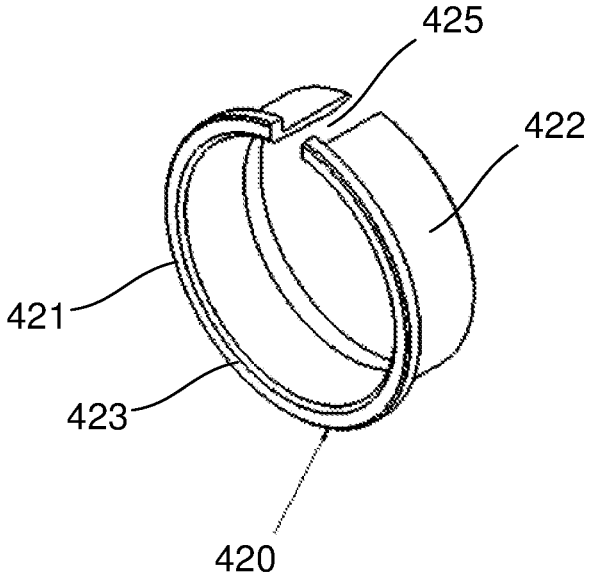
FIG. 4B is a schematic perspective view of a split reducing sleeve that is inserted into the back of the bolt hole in the liner prior to mill liner installation.

An example of a split reducing sleeve 420 is shown in FIG. 4B. The sleeve 420 has a ring shaped body having an internal diameter that tapers inwardly toward the inner face of the liner 402 from a first end 421 to a second end 422. A thin flange 423 radially extends around the first end 421 of the sleeve 420 which in use becomes seated on the rear face 402B of the liner 402 when fully pressed in as shown in FIG. 4A. The sleeve 420 further includes a split 425 along its length that allows the sleeve 420 to be easily pressed into the back of the liner by hand or with a light hammer tap on an assembly mandrel. The rubber lining 405 which lines the inside diameter of the mill shell would either be supplied with holes larger than the sleeve flange 423, or the rubber would simply be compressed locally around the sleeve flange 423. In FIG. 4A, the rubber lining 405 is shown with an enlarged hole opening such that it does not interfere with the sleeve flange 423.

When a mill reline is commenced, the liner bolt nut 404 is firstly removed from the liner bolt 403 by an operator outside of the mill. A liner bolt collar 310, for example as shown in FIG. 3C and previously described, is then threaded onto the shaft of the liner bolt 403.

The liner 402 is then typically supported on the inside of the mill by the mill relining machine as previously described to prevent the liner 402 from falling into the charge. With the liner 402 supported, an operator hammers the end of the liner bolt 403 from outside the shell 401 to thereby drive the liner bolt 403 through the shell 401. The liner bolt 403 is driven until the collar 310 jams into the split reducing sleeve 420 fitted into the back of the mill liner 402. As the collar 301 is tapered, it will become progressively more jammed in the sleeve 420 the more it is driven through the shell 401. Eventually, the collar 310 will prevent further movement of the liner bolt 403 and it will become retained or captured in the liner 402.

Figure 4C:
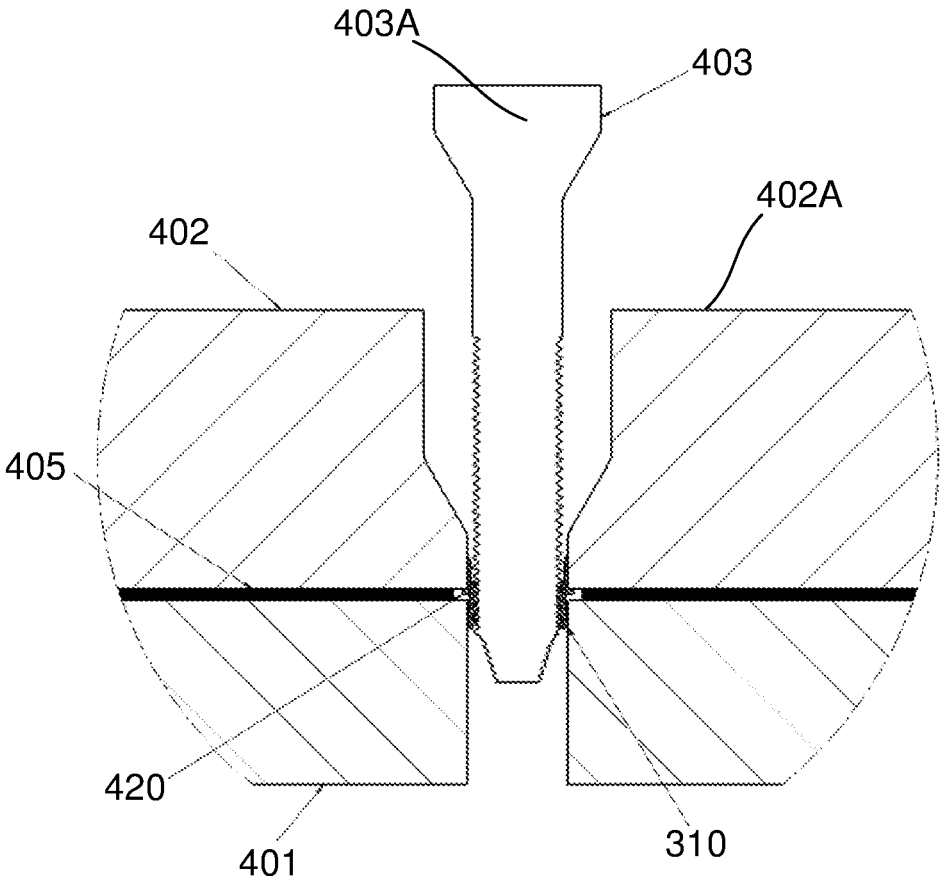
FIG. 4C is a schematic cross sectional view of the installation of FIG. 4A during liner removal.

In a retained position as shown in FIG. 4C, a head 403A of the liner bolt 403 is exposed so as to project proud of the liner 402 towards an interior of the mill. The head 403A must project sufficiently proud of the worn liner profile to enable a tool to grip the exposed head as will be described in further detail below.

Figure 5A:
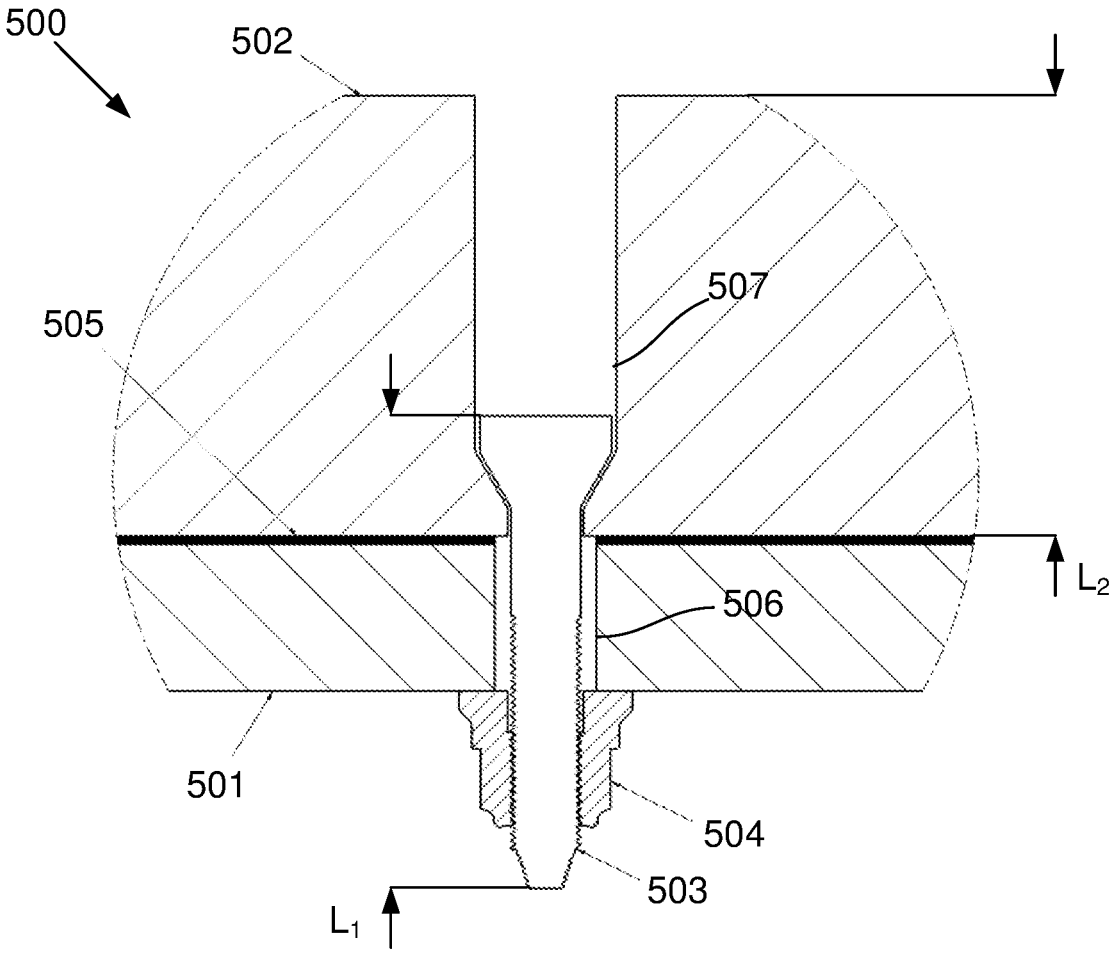
FIG. 5A is a schematic cross sectional view of an example of a mill liner installation arrangement in which the length of the liner bolt hole in the mill liner is nominally greater than the length of the liner bolt.

Referring now to FIG. 5A, an example of a mill liner installation arrangement 500 in which the length of the liner bolt hole in the mill liner is nominally greater than the length of the liner bolt is shown.

In this example, a deep liner 502 is fixed to a mill shell 501 via at least one liner bolt 503. The liner bolt 503 extends through a hole 507 in the liner 502 and a hole 506 in the shell 501 so that an end of the liner bolt protrudes outside the shell 501. The liner bolt 503 is fastened to the shell 501 by a nut (and captured washer) 504. A rubber lining 505 is used to line the inside diameter of the mill shell 501 and sits between the mill liner 502 and shell 501. It will be appreciated that the mill liner 502 is fitted into the mill, preferably using advanced mill relining techniques that do not require an operator to be present inside the mill, but that standard relining techniques where operators are present inside the mill could also be used.

The setup shown in FIG. 5A represents a setup used in an operating grinding mill, prior to a mill reline commencing. In this example, the length L1 of the liner bolt 503 is smaller than the length L2 of the bolt hole in the liner 502.

Figure 5B:
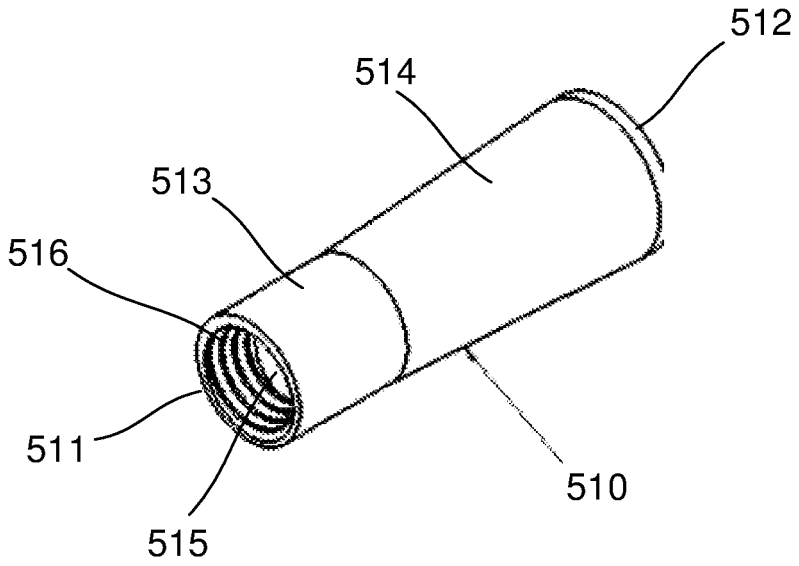
FIG. 5B is a schematic perspective view of an extended collar that is fitted onto the liner bolt in the mill liner arrangement of FIG. 5A during liner removal.

When a mill reline is commenced, the liner bolt nut 504 is firstly removed from the liner bolt 503 by an operator outside of the mill. An extended liner bolt collar 510, for example as shown in FIG. 5B, is then threaded onto the end of the liner bolt 503. The extended collar 510 has a first cylindrical body portion 513 and a second frusto-conical or tapered body portion 514. The second body portion 514 is typically solid whilst the first body portion 513 has an internally threaded recess 516 that extends from a first end 511 to a recess bottom 515. The internally threaded recess 516 has a thread that matches the tapered thread on the end of the liner bolt 503. As shown best in FIG. 5C, the extended collar 510 is threaded onto the end of the liner bolt 503 so that an end of the liner bolt 503 bottoms out on the recess bottom 515. In this way, when the liner bolt 503 is hammered out, the force of the hammer is transferred through the core material of the liner bolt 503 and extended collar 510 and not through the threads.

The liner 502 is then typically supported on the inside of the mill by the mill relining machine as previously described to prevent the liner 502 from falling into the charge. With the liner 502 supported, an operator hammers the end 512 of the extended collar 510 coupled to the liner bolt 503 from outside the shell 501 to thereby drive the liner bolt 503 through the shell 501. The liner bolt 503 is driven until the extended collar 510 jams into the back of the mill liner 502 proximate a rear face 502B thereof. As the second body portion 514 of the extended collar 510 is tapered, it will become progressively more jammed in the bolt hole of the liner 502 the more it is driven through the shell 501. Eventually, the collar 510 will prevent further movement of the liner bolt 503 and it will become retained or captured in the liner 502.

Figure 5C:
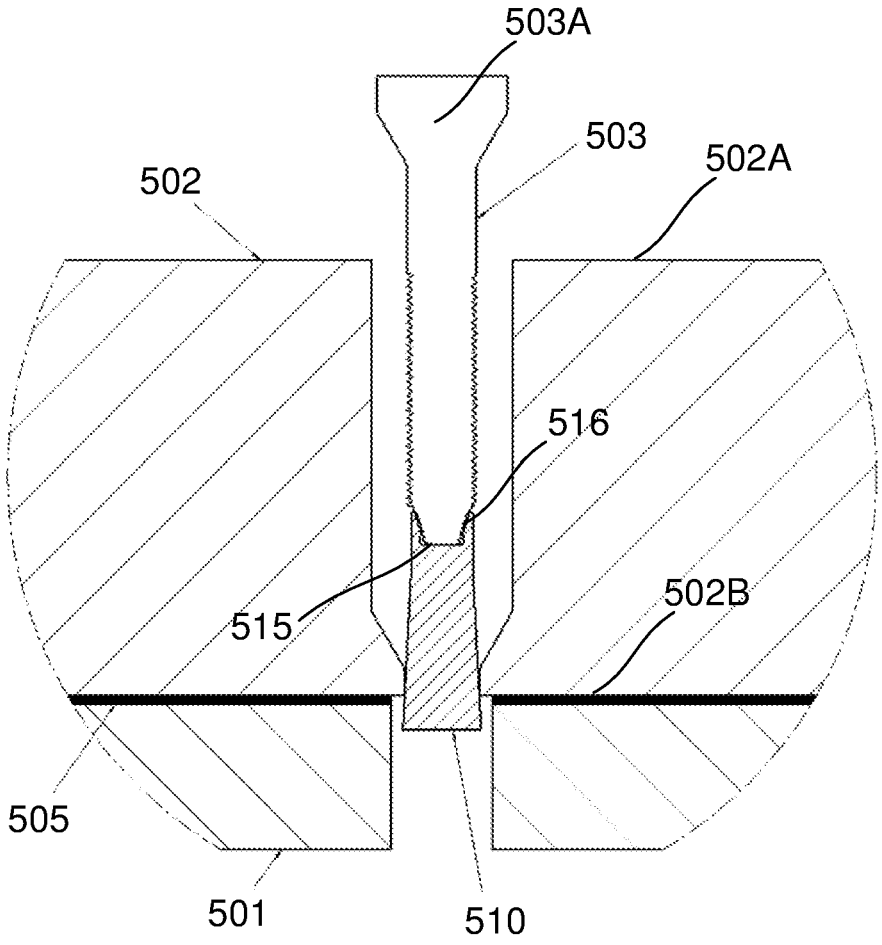
FIG. 5C is a schematic cross sectional view of the installation of FIG. 5A during liner removal.

In a retained position as shown in FIG. 5C, a head 503A of the liner bolt 503 is exposed so as to project proud of the liner 502 towards an interior of the mill. The head 503A must project sufficiently proud of the worn liner profile to enable a tool to grip the exposed head as will be described in further detail below. Accordingly, it will be appreciated that the length of the extended collar 510 must sufficiently extend the length of the liner bolt 503 to achieve this.

Figure 6A:
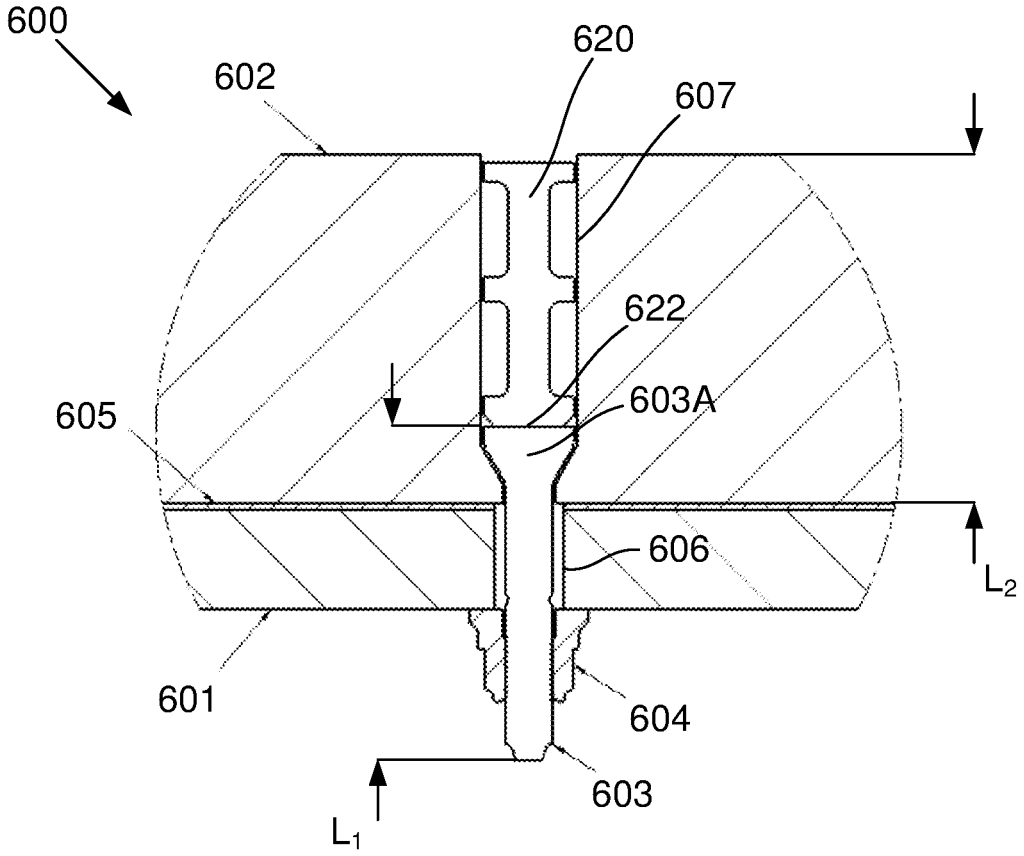
FIG. 6A is a schematic cross sectional view of an example of a mill liner installation arrangement having a deep liner in which the liner bolt has an extended head so as to extend the effective length of the liner bolt.

Referring now to FIG. 6A, a further example of a deep mill liner installation arrangement 600 is shown in which the length of the liner bolt hole in the mill liner is nominally greater than the length of the liner bolt.

In this example, a deep liner 602 is fixed to a mill shell 601 via at least one liner bolt 603 having an extended head portion 620 as will be discussed in more detail below. The liner bolt 603 extends through a hole 607 in the liner 602 and a hole 606 in the shell 601 so that an end of the liner bolt protrudes outside the shell 601. The liner bolt 603 is fastened to the shell 601 by a nut (and captured washer) 604. A rubber lining 605 is used to line the inside diameter of the mill shell 601 and sits between the mill liner 602 and shell 601. It will be appreciated that the mill liner 602 is fitted into the mill, preferably using advanced mill relining techniques that do not require an operator to be present inside the mill, but that standard relining techniques where operators are present inside the mill could also be used.

The setup shown in FIG. 6A represents a setup used in an operating grinding mill, prior to a mill reline commencing. In this example, the length L1 of the liner bolt 603 is smaller than the length L2 of the bolt hole in the liner 602.

When a mill reline is commenced, the liner bolt nut 604 is firstly removed from the liner bolt 603 by an operator outside of the mill. A liner bolt collar 310, for example as shown in FIG. 3C and as previously described, is then threaded onto the shaft of the liner bolt 603.

The liner 602 is then typically supported on the inside of the mill by the mill relining machine as previously described to prevent the liner 602 from falling into the charge. With the liner 602 supported, an operator hammers the end of the liner bolt 603 from outside the shell 601 to thereby drive the liner bolt 603 through the shell 601. The liner bolt 603 is driven until the collar 310 jams into the back of the mill liner 602 proximate a rear face 602B thereof. As the collar 310 is tapered, it will become progressively more jammed in the bolt hole of the liner 602 the more it is driven through the shell 601. Eventually, the collar 310 will prevent further movement of the liner bolt 603 and it will become retained or captured in the back of the liner 602.

Figure 6B:
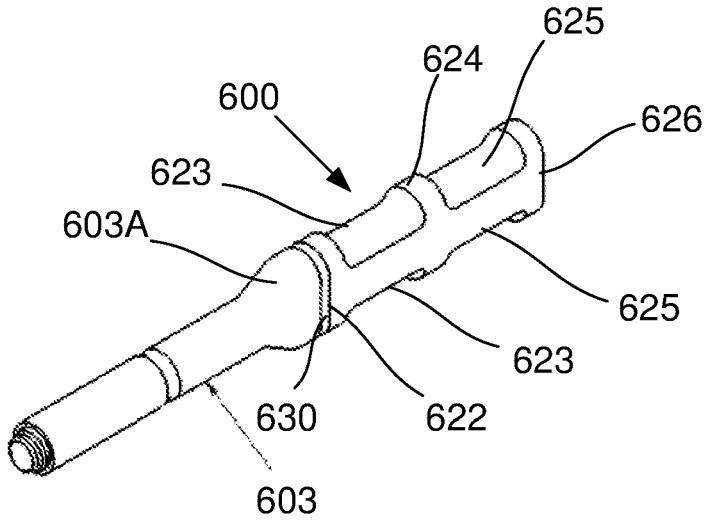
FIG. 6B is a schematic perspective view of an example of a liner bolt having an extended head.
Figure 6C:
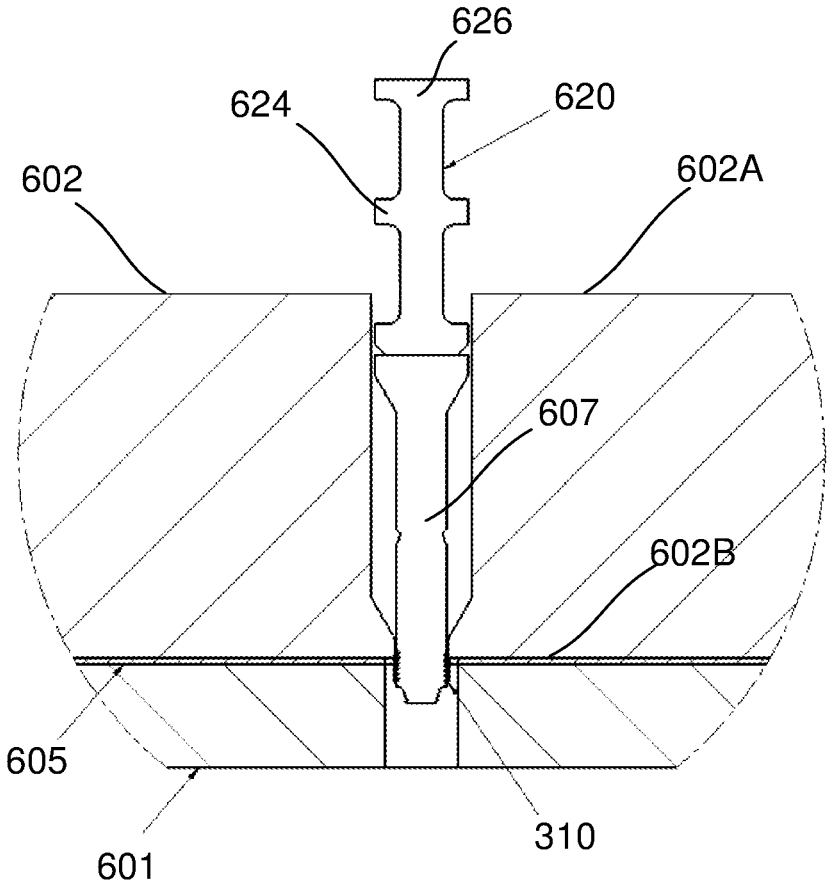
FIG. 6C is a schematic cross sectional view of the installation of FIG. 6A during liner removal.

In a retained position as shown in FIG. 6C, a portion 624, 626 of the extended head portion 620 of the liner bolt 603 is exposed so as to project proud of the inside face 602A of the liner 602 towards an interior of the mill. The extended head portion 620 must project sufficiently proud of the worn liner profile to enable a tool to grip the extended head as will be described in further detail below.

The extended head portion 620 of the liner bolt 603 may be welded to a head 603A of a standard liner bolt 603 for example as shown in FIG. 6A. In FIG. 6B, a weld line 630 is shown between the standard liner bolt head 603A and the extended head portion 620. Alternatively, the extended head portion may be cast or forged as part of the liner bolt such that the extended head and liner bolt are a single homogenous part. The extended head portion 620 may take any suitable form so long as one or more engagement portions are provided for so that the tool is able to grip it.

In the example shown in FIG. 6B, the extended head portion 620 comprises an elongate shaft extending between a base end 622 and a head end 626. Along the length of the shaft are recessed sections 623, 625 that may in one example, be in the form of flat recesses or radial cut-outs. The recessed sections 623, 625 are typically spaced apart so that flanged sections are formed at the respective base and head ends 622, 626 as well as at an intermediate section 624. In use, the tool is able to catch behind either the intermediate or end flange section thereby enabling the tool to grip the extended head portion 620 when it projects proud of the liner face 602A.

The use of an extended head portion of the liner bolt therefore enables the effective length of the liner bolt to be increased which addresses the problem of standard liner bolts being too short to extend proud of the face of the mill liner when hammered through the shell such is the case of deep liners where the liner bolt hole in the mill liner is very deep relative to the length of the liner bolt. It is to be appreciated that a liner bolt having an extended head portion may also be used in any of the previous arrangements and methods described.

All of the methods described above result in the liner bolts being retained or captured within the mill liner, leaving the head of the liner bolt projecting proud of the face of the liner profile. With the head of the bolt projecting proud, it is possible to engage a tool with the exposed liner bolt head to thereby permit the liner to be removed from the mill shell.

Figure 7A:
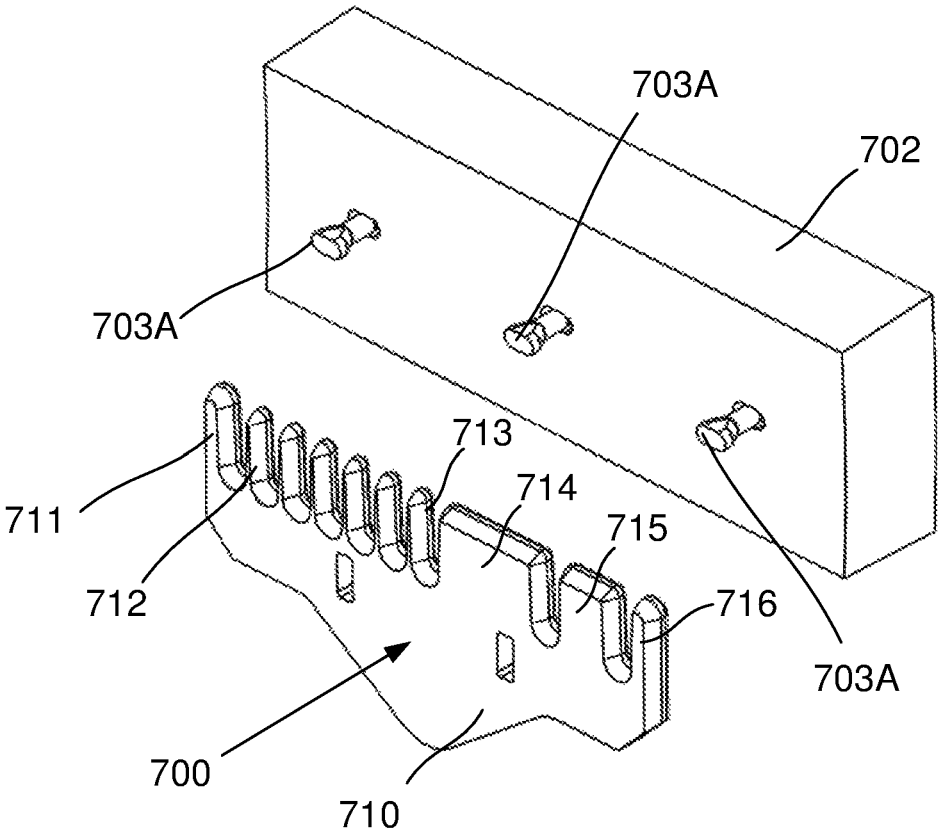
FIG. 7A is a schematic perspective view of an example of a tool used to grip exposed liner bolts approaching a mill liner to facilitate liner removal; and, FIG. 7B is a schematic perspective view of the tool of FIG. 7A gripping the mill liner via the exposed liner bolts.
Figure 7B:
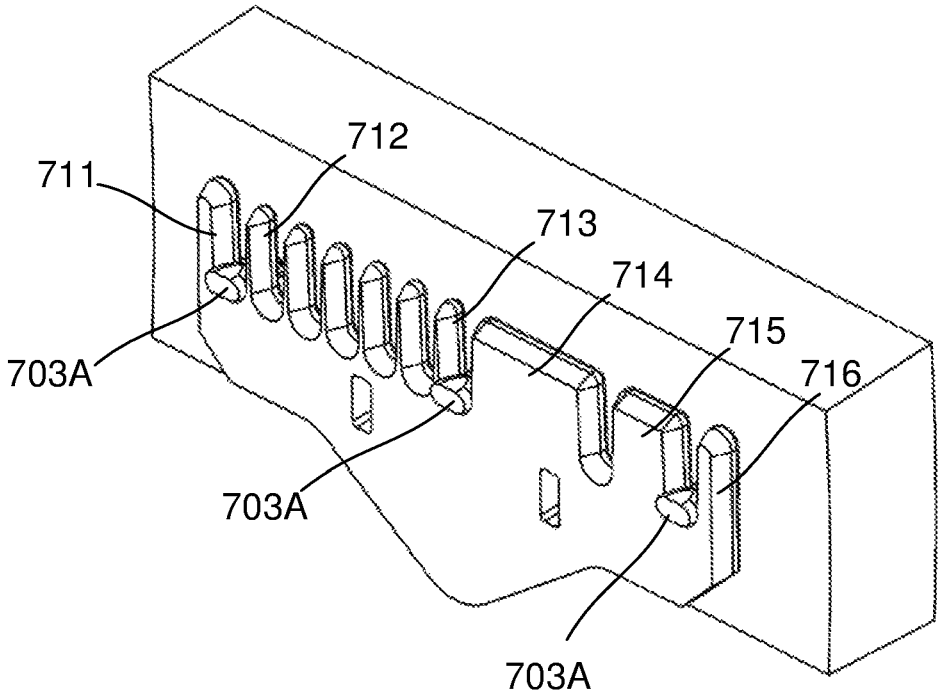

Referring now to FIGS. 7A and 7B, there is shown a tool 700 for engaging the liner bolts and facilitating removal of the worn liner 702 from the mill. As shown in FIG. 7A, the oblong shaped liner bolt heads 703A are exposed such that they project proud from an inner face of the worn liner 702.

A tool 700 in the form of an adaptor plate is provided to selectively grip the liner bolts. The tool 700 has a body 710 capable of being connected to a mill reline machine, for example to an arm, boom or the like of the machine that is able to be controlled to thereby move the tool 700 as required.

In this example, the body 710 of the tool 700 includes a plurality of spaced apart teeth 711, 712, 713, 714, 715, 716 defining slots therebetween for receiving at least a portion of the head 703A of a respective liner bolt. Where the liner bolts are configured with an extended head, the slots may at least partially receive or engage with a flange portion of the extended head. The teeth of the adaptor plate would be set at specific centers to match the various different combinations of liner bolt centers of the different liners in the mill. Furthermore, adjacent teeth of the adaptor plate are profiled so as to correspond with a tapered section of the head 703A of the liner bolt to facilitate a strong connection therebetween. In operation, the mill reline machine would manipulate the position of the tool 700 with respect to the liner so that the projecting liner bolts are aligned with the appropriate slots in the tool. The tool 700 would then be lifted up to engage the liner bolts from underneath and cause the tapered section of the liner bolt heads to be received in the respective and complementary shaped slots. In the example shown in FIG. 7B, the liner bolt heads 703A are respectively engaged between teeth ((711, 712), (713, 714), and (715, 716)).

Once the tool is properly engaged with the liner bolts, the mill reline machine can be controlled to lift the tool and thereby the liner away from the mill shell and subsequently out of the mill.

Accordingly, in at least one example, there is provided a method and system enabling a worn liner to be safely and securely removed from a mill without the need for an operator to be present inside the mill. This is achieved by providing a method whereby a worn liner can be connected to a mill reline machine without having an operator to manually make the connection. Removing the operator from inside the mill improves safety and mitigates the risk of injury or death from work in such a dangerous environment.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

Persons skilled in the art will appreciate that numerous variations and modifications will become apparent. All such variations and modifications which become apparent to persons skilled in the art, should be considered to fall within the spirit and scope that the invention broadly appearing before described.

The claims defining the invention are as follows:

1. A method of removing a liner from a mill, the liner fastened to a mill shell by at least one liner bolt, the method including:

a) coupling a retaining element onto the at least one liner bolt;

b) driving the at least one liner bolt through the mill shell until the retaining element becomes jammed in a liner bolt hole of the liner to thereby retain the liner bolt in the liner, whereby in a retained position, a head of the at least one liner bolt is exposed so as to project proud of the liner towards an interior of the mill;

c) engaging a tool onto the at least one liner bolt; and, d) lifting the liner away from the mill shell using the tool to thereby enable the liner to be removed from the mill.

2. The method according to claim 1, wherein the tool is engaged onto at least a portion of the exposed head of the at least one liner bolt.

3. The method according to claim 1, wherein:

a) the at least one liner bolt is retained proximate a rear face of the liner; and, b) the retaining element is a collar that is threadedly engaged onto the at least one liner bolt.

4. The method according to claim 3, wherein a) the collar is tapered;

b) the collar is positioned on a shaft portion of the at least one liner bolt; and, c) a diameter of the liner bolt hole in the liner is smaller than a diameter of a liner bolt hole in the mill shell.

5. The method according to claim 3, wherein during liner installation, a split reducing sleeve is inserted into the liner bolt hole of the liner proximate the rear face thereof so as to reduce the effective diameter of the liner bolt hole.

6. The method according to claim 3, wherein:

a) the collar is threaded onto the end of the at least one liner bolt so as to extend the effective length of the at least one liner bolt; and, b) a length of the liner bolt hole in the liner is greater than a length of the at least one liner bolt.

7. The method according to claim 1, wherein the at least one liner bolt has an extended head portion configured so as to extend the effective length of the liner bolt.

8. The method according to claim 7, wherein at least one of:

a) the extended head portion is one of:

i) attached to the head of the at least one liner bolt; and, ii) integrally formed as part of the head of the at least one liner bolt; and, b) the extended head portion provides one or more engagement portions to which the tool can be engaged to lift the liner away from the shell.

9. The method according to claim 8, wherein the extended head portion is one of:

a) welded to the head of the at least one liner bolt; and, b) cast or forged as part of the at least one liner bolt.

10. The method according to claim 1, wherein the liner is supported on the inside of the mill by a mill reline machine whilst the at least one liner bolt is driven through the mill shell.

11. The method according to claim 10, wherein at least one of:

a) the tool is securely attached to the mill reline machine; and, b) the tool is an adaptor plate having a plurality of spaced apart teeth defining slots therebetween for receiving at least a portion of the head of the at least one liner bolt, the method further including aligning respective slots of the adaptor plate with the at least one liner bolt head and selectively gripping the at least one liner bolt by guiding the aligned slots onto the head of the at least one liner bolt.

* * * * *